US008653391B2

(12) United States Patent
Patten et al.

(10) Patent No.: US 8,653,391 B2
(45) Date of Patent: Feb. 18, 2014

(54) MANUAL TRIPPING DEVICE FOR CIRCUIT BREAKER

(75) Inventors: Robert A. Patten, Deltona, FL (US); Martin E. Geary, Clermont, FL (US); Kerry Brent Binkley, Lake Mary, FL (US)

(73) Assignee: ABB Technology AG, Zurich (CH)

( * ) Notice: Subject to any disclaimer, the term of this patent is extended or adjusted under 35 U.S.C. 154(b) by 257 days.

(21) Appl. No.: 13/147,647

(22) PCT Filed: Feb. 8, 2010

(86) PCT No.: PCT/US2010/023460

§ 371 (c)(1), (2), (4) Date: Dec. 15, 2011

(87) PCT Pub. No.: WO2010/096290

PCT Pub. Date: Aug. 26, 2010

(65) Prior Publication Data

US 2012/0103771 A1 May 3, 2012

Related U.S. Application Data

(60) Provisional application No. 61/153,007, filed on Feb. 17, 2009.

(51) Int. Cl.
*H01H 23/00* (2006.01)

(52) U.S. Cl.
USPC ..... 200/401

(58) Field of Classification Search
USPC ..... 200/400–401, 337
See application file for complete search history.

(56) References Cited

U.S. PATENT DOCUMENTS

| | | | | |
|---|---|---|---|---|
| 2,436,194 | A | 8/1945 | Bush | |
| 4,283,610 | A | 8/1981 | Date et al. | |
| 4,358,648 | A | 11/1982 | Crookston et al. | |
| 5,569,891 | A | 10/1996 | Freeman et al. | |
| 5,838,219 | A * | 11/1998 | Du et al. | 335/14 |
| 6,545,234 | B1 | 4/2003 | Trivette et al. | |
| 6,870,451 | B1 * | 3/2005 | Inoue | 335/172 |
| 6,930,271 | B1 * | 8/2005 | Palmieri et al. | 218/154 |
| 7,132,911 | B2 * | 11/2006 | Chung et al. | 335/6 |
| 7,312,680 | B2 * | 12/2007 | Wang | 335/238 |
| 7,545,245 | B2 * | 6/2009 | Zhou et al. | 335/27 |
| 7,863,534 | B2 * | 1/2011 | Narayanasamy et al. | 200/400 |
| 2002/0179571 | A1 | 12/2002 | Rhein et al. | |
| 2006/0162194 | A1 | 7/2006 | Wang | |
| 2007/0252667 | A1 | 11/2007 | Zhou et al. | |
| 2008/0047813 | A1 | 2/2008 | Vestner et al. | |

FOREIGN PATENT DOCUMENTS

WO 2010096290 A1 8/2010

* cited by examiner

*Primary Examiner* — Xuong Chung Trans
(74) *Attorney, Agent, or Firm* — Michael C. Prewitt; Denis Ticak

(57) ABSTRACT

A permanently installed manual trip mechanism is mounted internally to a circuit breaker with a user operated handle extending to the outside of the enclosure. The mechanism converts a relatively small operator input to larger spring charge. Upon triggering, the mechanism provides the required operating velocity of the circuit breaker during the opening stroke for load break operation.

17 Claims, 18 Drawing Sheets

MANUAL TRIPPING DEVICE FOR CIRCUIT BREAKER

CLAIM OF PRIORITY

This application claims priority to U.S. Provisional Application No. 61/153,007 filed on Feb. 17, 2009 and entitled Manual Tripping Device for Circuit Breaker, the contents of which are incorporated by reference in their entirety.

BACKGROUND

Circuit breakers are commonly found in substations and are operable to selectively open and close electrical connections. Modern medium to high voltage circuit breakers include automatic, electronically controlled actuating systems that recognize fault conditions and initiate trip sequences. These electronically controlled breakers may also be remotely actuated from an off-site location, such as a power utility operational control room.

Despite the highly automated nature of modern circuit breakers, the need still exists for reliable and safe means to manually actuate (open) the breaker. Manual tripping (opening) of a circuit breaker must follow through the stroke of the actuation with enough force to achieve proper contact velocities (i.e. the velocity the two contacts are drawn apart) regardless of the amount of energy remaining in the "wipe" contact springs. As the contacts erode, the amount of force and stored energy in the circuit breaker decreases and the force and energy required by the manual tripping device to open the circuit breaker increases. The design of the manual tripping device is such that it functions properly with the minimum amount of contact wipe spring compression on all phases (or worst case condition). Forces that must be overcome by a manual actuation mechanism include: the magnetic holding force of the magnetic actuators (from installed permanent magnets), weld break of any contacts if needed, operating friction and acceleration of mass in various parts. In medium voltage outdoor circuit breakers (i.e. 5 kV through 38 kV), the magnetic holding force of the actuator is based on the interrupting rating and requires enough holding force to withstand the forces generated by approximately 12 to 50 kA rms, asym fault current and possibly higher. This force is counteracted by the total "wipe" spring contact force acting on the actuator. The wiping spring contact force reduces the manual tripping force requirement, but the holding force of the actuator remains a significant value, and the resulting net latching force (manual tripping force required) can be over 1000 lbs in a circuit breaker with a high short circuit rating. In addition, the human operator should not be required to apply greater than a 50 lb force to a lever or handle to manually trip the unit.

Some prior art manual actuation devices incorporate an automatic spring charged mechanism for opening and closing operations. According to these designs, energy is transferred from a power device, such as an electric motor, and stored in a spring system which holds the charge indefinitely, even in the absence of control power to the motor. When triggered manually, the mechanism provides the tripping (opening) energy and operation of the circuit breaker. Such solutions are relatively more expensive, as they require an internal source of input power (electric motor). Further, if the spring charge is exhausted, no further operation is possible unless power is available to the input power source. Further, such mechanisms typically require a regular maintenance cycle, due to the use of the older electric motor and an excessive amount of small parts in the mechanism. Such maintenance cycles are disadvantageous, as operators prefer maintenance free equipment wherever possible.

Thus, there is a need in the art for a manual tripping mechanism that can initiate and complete the manual tripping operation without any motorized spring charging mechanism and is operable with reduced input force applied by an operator on the lever.

SUMMARY OF THE INVENTION

According to one aspect of the present invention a manual operating mechanism is provided for a circuit breaker having a breaker shaft operatively connected to one or more poles. The manual operating mechanism includes an operating shaft having a handle secured thereto. A charging assembly is operatively engaged with the operating shaft through a radially offset linkage. The charging assembly carries a main spring. A trigger assembly engages and selectively supports a first end of the main spring. Rotation of the operating shaft in a first direction causes the main spring to compress against the trigger assembly until a trigger point is reached. When the trigger point is reached, the trigger assembly stops supporting the first end of the main spring and the main spring operatively engages the breaker shaft to cause movement thereof.

According to another aspect of the present invention a manual operating mechanism is provided for a circuit breaker having a breaker shaft operatively connected to one or more poles. The manual operating mechanism includes an operating shaft having a handle secured thereto. A charging assembly is operatively engaged with the operating shaft. The charging assembly carries a main spring. A trigger assembly engages and selectively supports a first end of the main spring. The trigger assembly includes a trigger. A toggle assembly is operatively connected to the operating shaft and alternately aids or resists rotation of the operating shaft depending on the angular position of the operating shaft. Rotation of the operating shaft in a first direction causes the main spring to compress against the trigger assembly until the toggle assembly contacts the trigger, at which time, the trigger assembly stops supporting the first end of the main spring and the main spring operatively engages the breaker shaft to cause movement thereof.

DETAILED DESCRIPTION OF THE INVENTION

Figure 1:
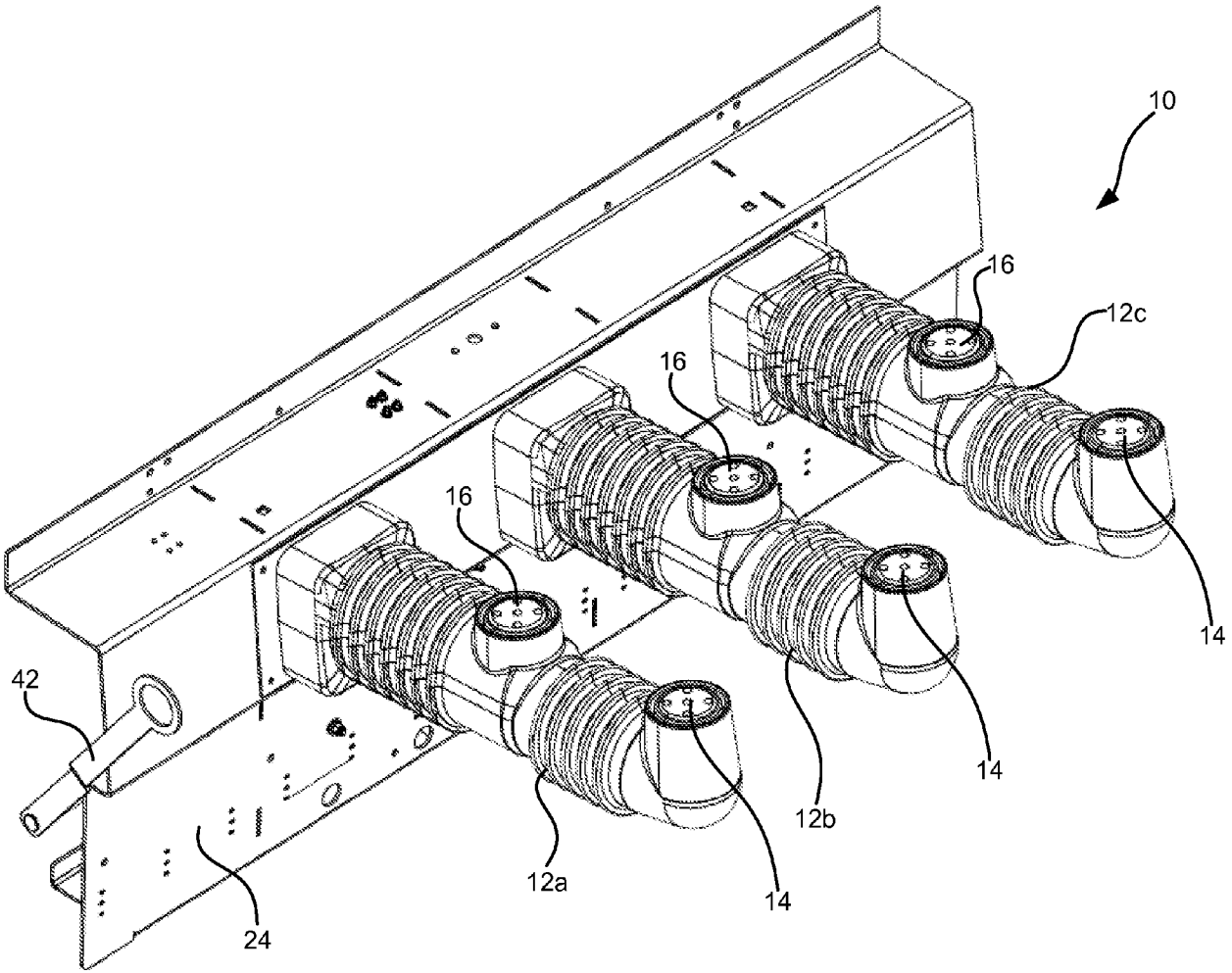
FIG. 1 is an elevated view of a breaker having a manual actuator according to the present invention.
Figure 2:
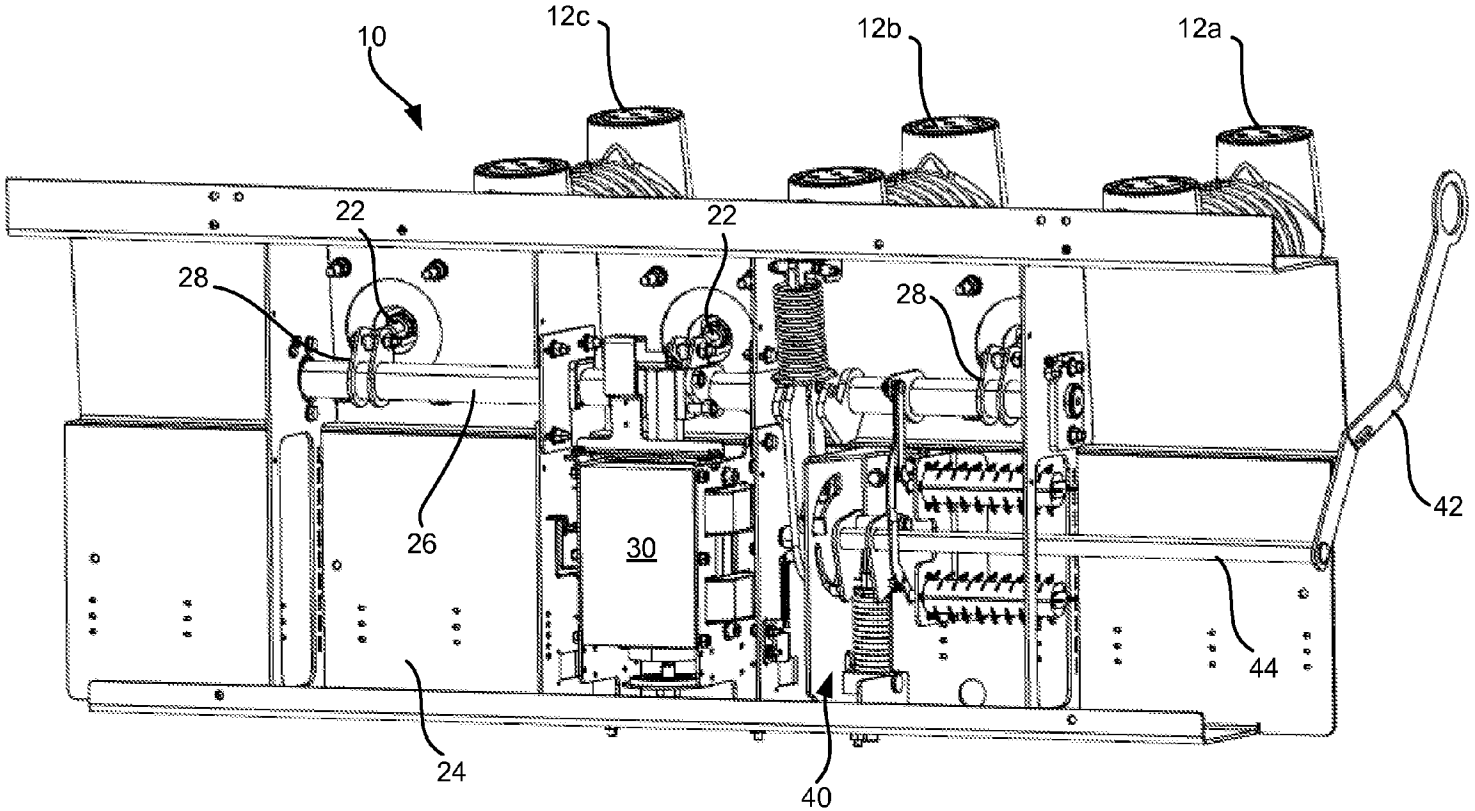
FIG. 2 shows an elevated rear view of a breaker according to FIG. 1.

With Reference now to FIGS. 1 and 2, a circuit breaker is shown and generally indicated with the numeral 10. Circuit breaker 10 is a three phase circuit breaker, and thus includes three poles 12*a*, 12*b* and 12*c*. Each pole includes a first exterior electrical connection 14 and a second exterior electrical connection 16. As is known in the art, electrical power lines are coupled to first exterior connection 14 and second exterior connection 16 and breaker 10 selectively opens or closes the electrical connection therebetween.

Figure 3:
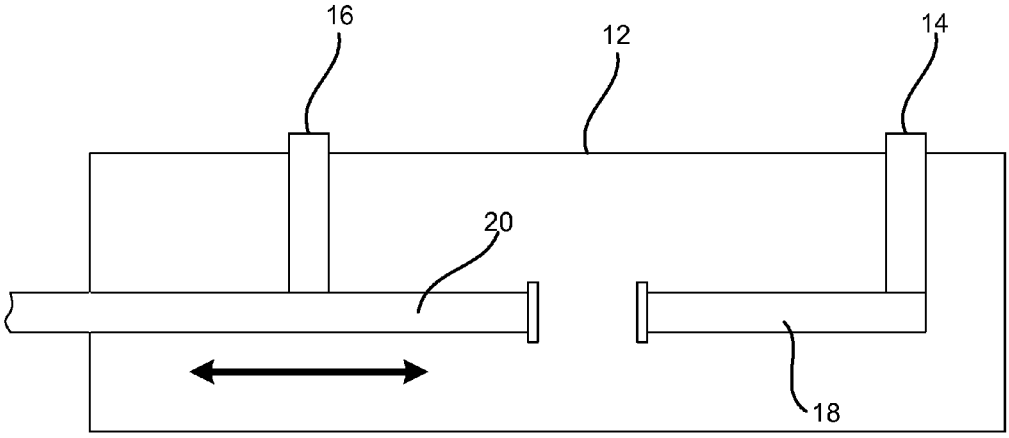
FIG. 3 shows a partially schematic view of the interior of a pole as shown in FIG. 1 wherein the internal contacts are open.
Figure 4:
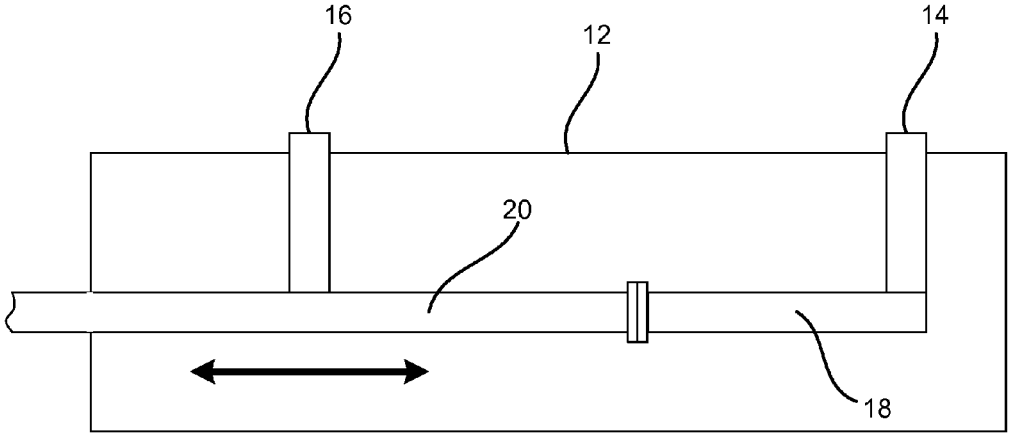
FIG. 4 shows a partially schematic view of the interior of a pole as shown in FIG. 1 wherein the internal contacts are closed.

With reference to FIGS. 3 and 4, a simplified view of the interior of the poles 12 is shown, wherein first exterior electrical connection 14 is electrically connected to a stationary contact 18 which is immovably secured within pole 12. Second exterior electrical connection 16 is electrically connected to a movable contact 20 which is carried within pole 12 in a manner allowing longitudinal movement therein. Thus, in a first position, the movable contact 20 may be positioned to break the electrical connection between first exterior electrical connection 14 and second exterior electrical connection 16 (see FIG. 3). In a second position, the movable contact 20 may be brought into contact with stationary contact 18 to electrically connect the first exterior electrical connection 14 and the second exterior electrical connection 16 (see FIG. 4). In one or more embodiments, poles 12 may contain isolative materials such as oils or inert gasses. In other embodiments, the interior of poles 12 may be devoid of gasses or liquids (i.e. vacuum). Each pole 12 may further include wipe springs (not shown) that are positioned to maintain contact pressure between stationary and movable contacts 18 and 20 when they are in the second, engaged position.

With reference to FIG. 2, an actuating rod 22 extends into each pole 12 and is mechanically, connected to the movable contact 20 in each pole. Thus, the longitudinal movement of actuating rod 22 causes the movement of movable contact 20 as discussed above. The actuating rod 22 for each of the three poles 12 extends into a housing 24 (shown with the rear and side covers removed for clarity). Within housing 24, a crank shaft 26 is positioned, having an axis of rotation perpendicular to the longitudinal movement of actuating rods 22. All three actuating rods 22 are coupled to crank shaft 26 through brackets 28. In this manner, it can be seen that rotation of crank shaft 26 causes predominately longitudinal movement of actuating rods 22. Thus, rotation of crank shaft 26 causes the movement of movable contact 20, which consequently opens or closes the electrical connection between first and second exterior electrical connections 14 and 16.

Figure 5:
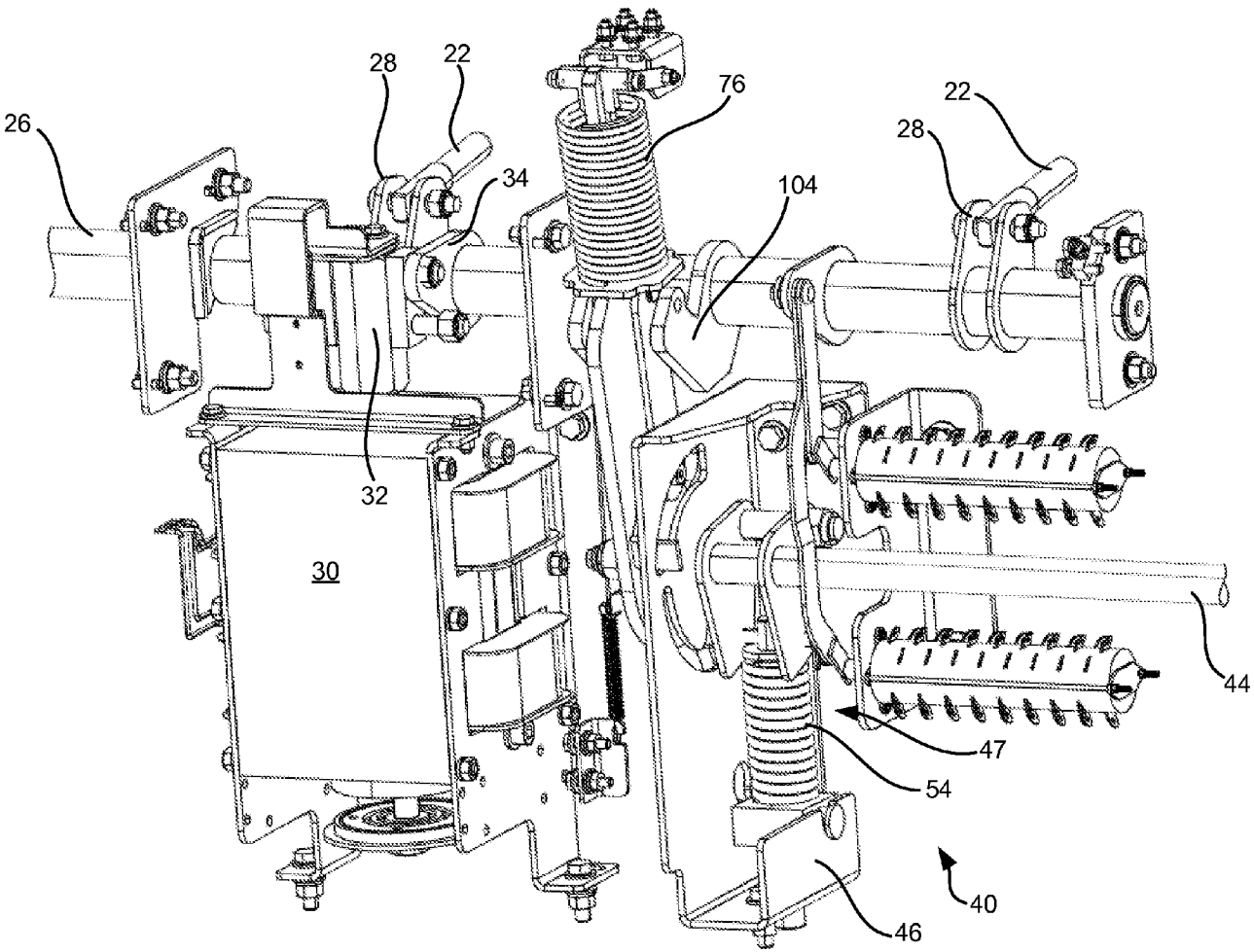
FIG. 5 shows a rear view of the breaker of FIG. 1 with the housing and poles removed for clarity.
Figure 6:
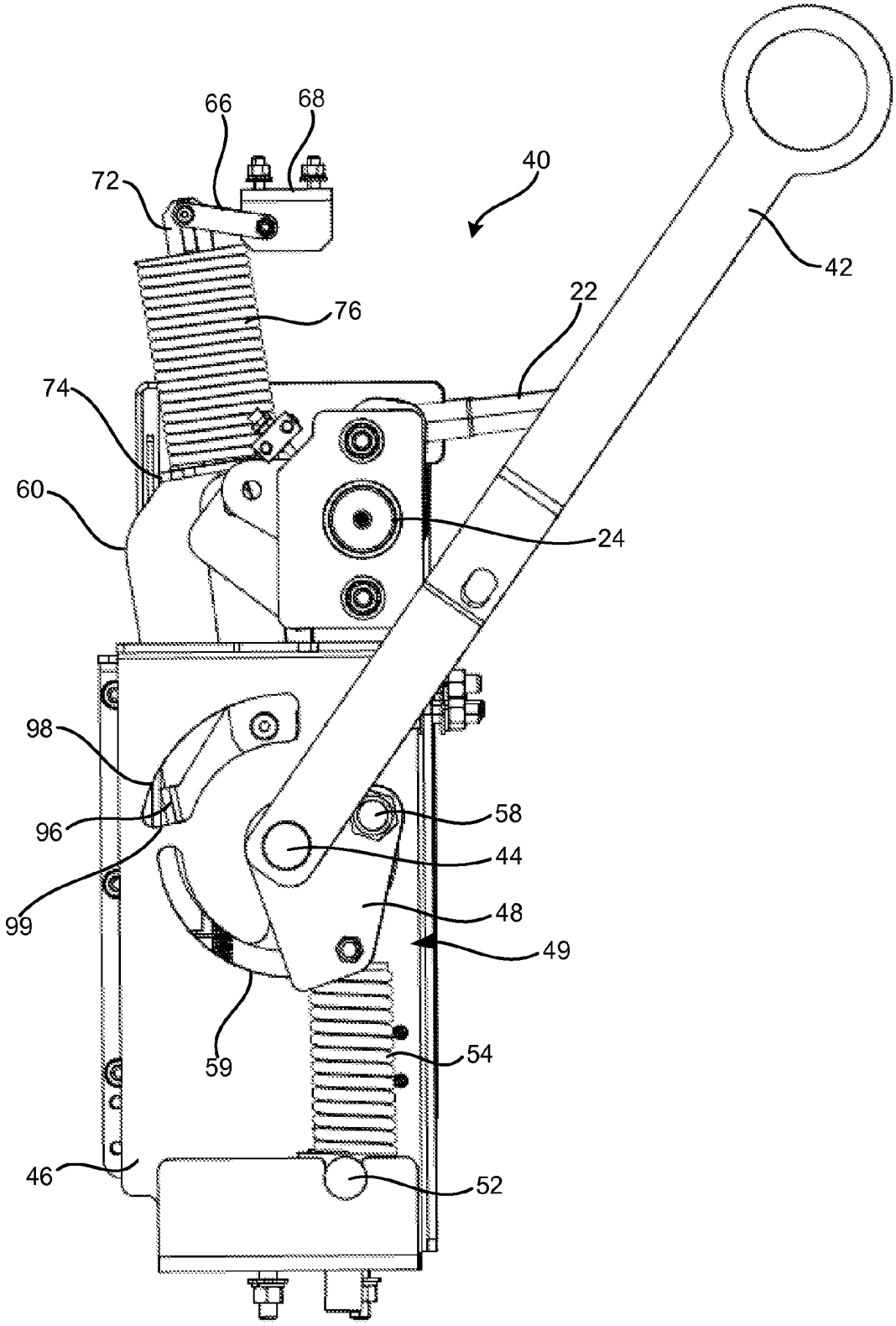
FIG. 6 shows a side profile view of the manual actuator in a first, steady state position according to the present invention wherein the housing, poles and magnetic actuator are removed for clarity.
Figure 7:
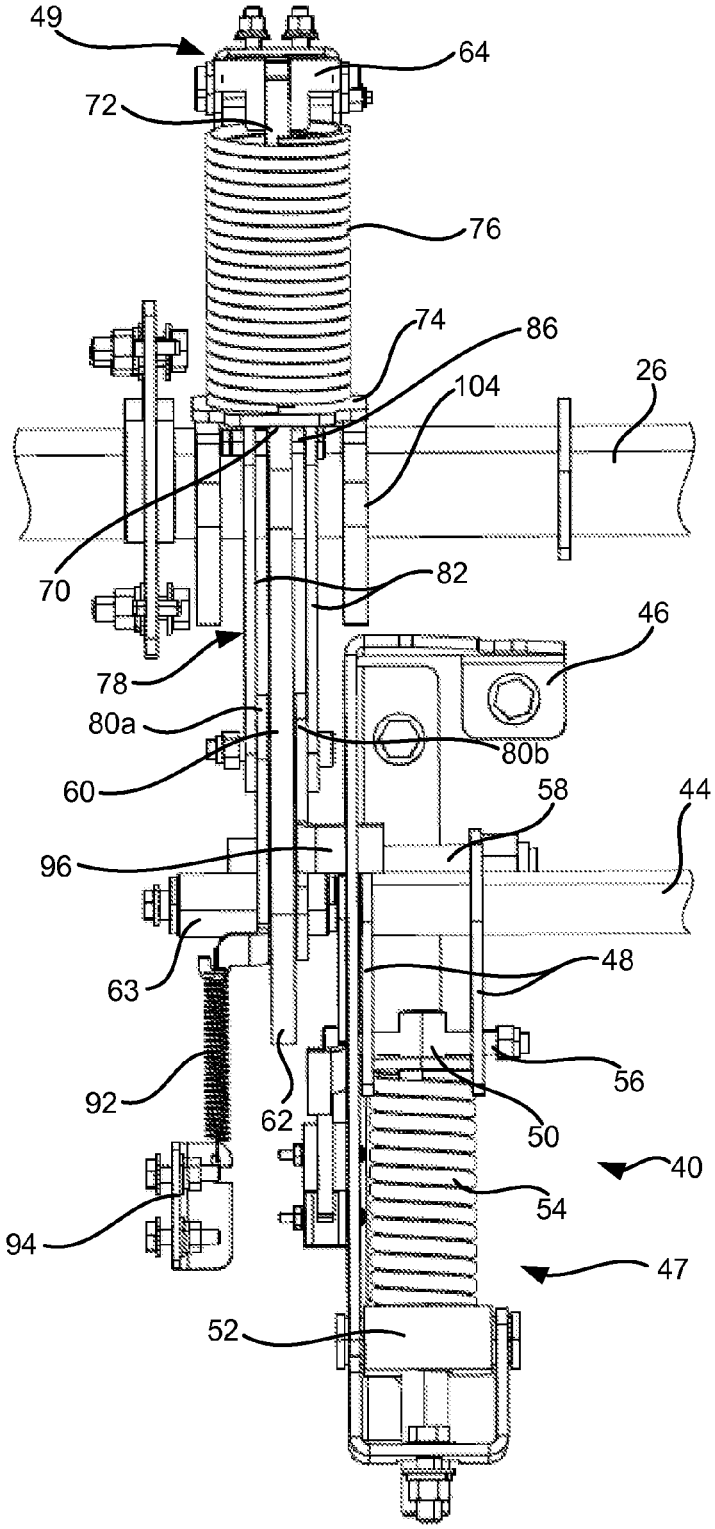
FIG. 7 is a rear view of a of the manual actuator of FIG. 6.
Figure 8:
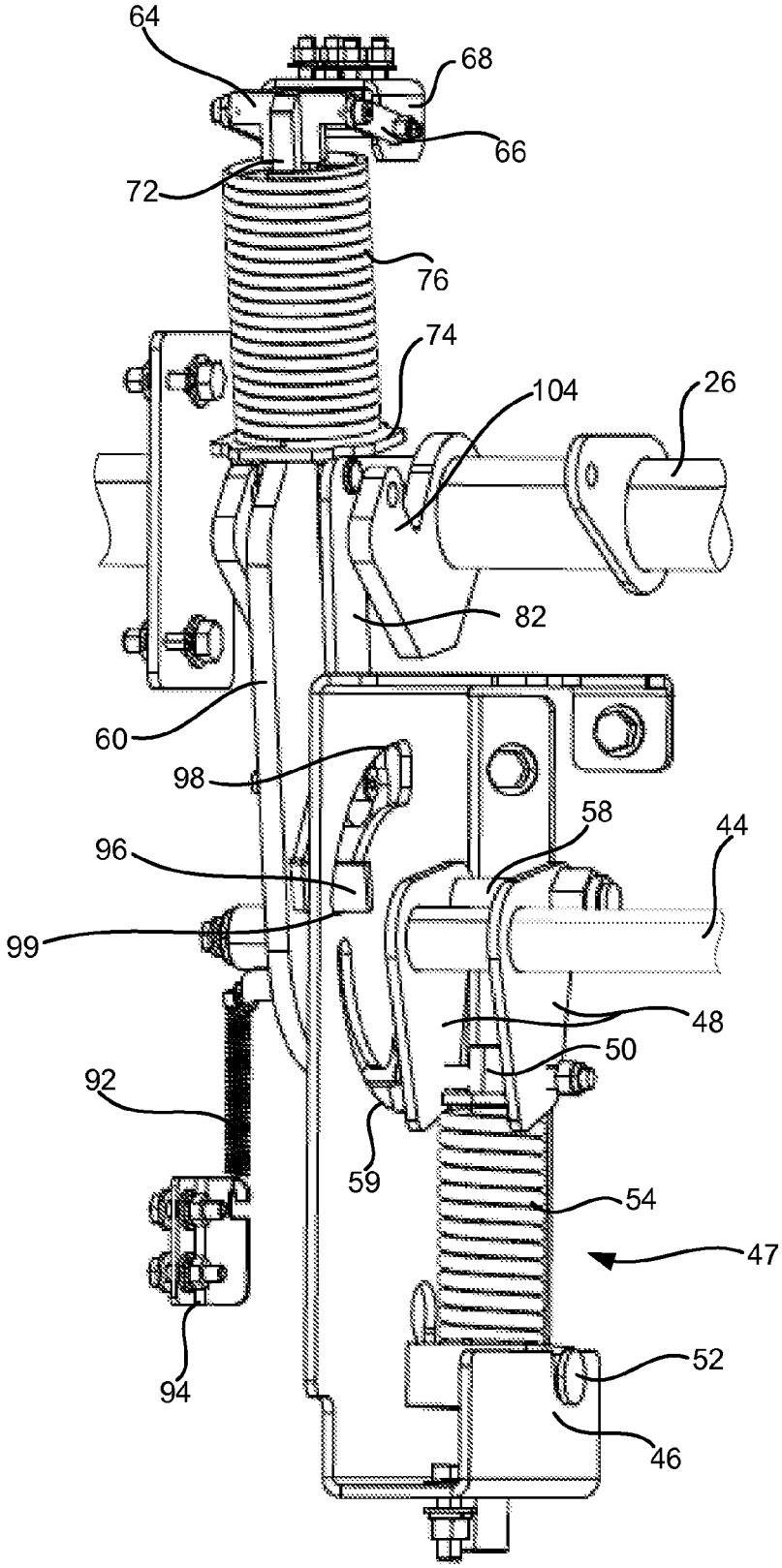
FIG. 8 is a rear and right side view of the manual actuator of FIG. 6.
Figure 9:
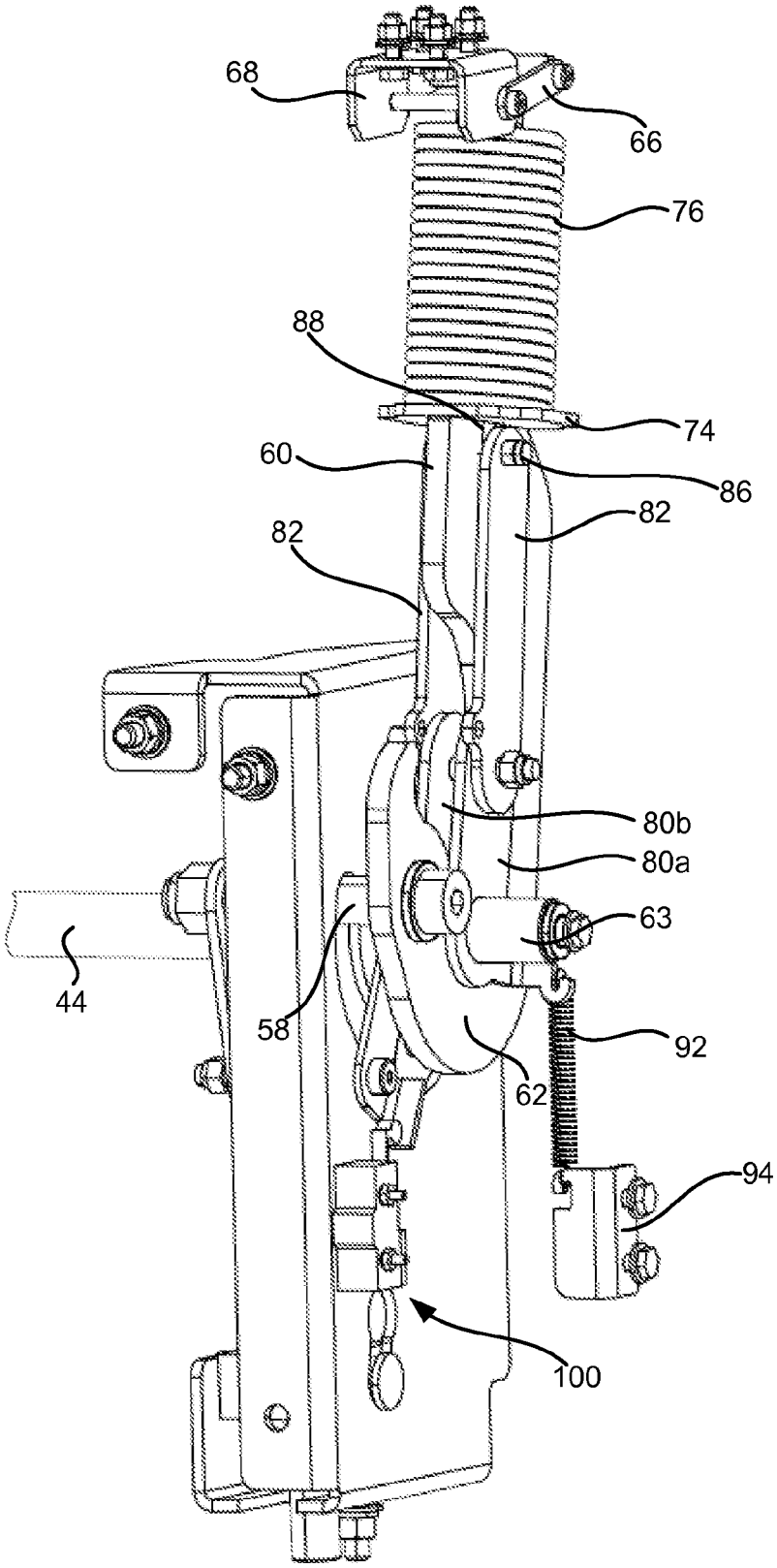
FIG. 9 is a rear and left side view of the manual actuator of FIG. 6.

As discussed above, normal opening and closing of the circuit breaker is performed automatically by a magnetic actuator 30. Reference is now made to FIG. 5, which shows breaker 10 with poles 12 and housing 24 removed for clarity. Magnetic actuator 30 includes a driving shaft 32 that is coupled to crank shaft 26 through a bracket 34. Driving shaft 32 is selectively driven upward or downward by electrically powered coils. Upward or downward movement causes rotation of crank shaft 26. When in the open or closed position, internal magnets then hold the driving shaft 32 in position. Magnetic actuator 30 may be triggered by on-board electronics reacting to a sensed fault or other condition. Magnetic actuator 30 may also be triggered remotely upon receipt of a trip command from a utility control room operator.

Though the magnetic actuator 30 provides the normal actuation of breaker 10, in many instances, manual actuation of the breaker is required. For example, manual actuation may be required if magnetic actuator power is lost, if the magnetic actuator malfunctions or is damaged, if there was a system failure electrically or mechanically, or if local ground personnel wish to manually block the operation of the breaker during maintenance. In such situations, a manual actuator 40 according to the present invention is provided to allow a local, human operator to manually operate breaker 10.

With reference now to FIGS. 2, and 6-9, manual actuator 40 includes an exterior handle 42 that is provided for a human operator to impart a force. Exterior handle 42 is secured to an operating shaft 44 positioned within housing 24, such that, when a force is applied to handle 42 by a utility service person, operating shaft 44 will rotate. The axis of rotation of crank shaft 26 and operating shaft 44 are parallel and vertically offset. Operating shaft 44 is carried at one end on a housing bushing (not shown) and at the opposed end, by a bushing (not shown) in a support bracket 46.

A toggle assembly 47 is provided proximate to support bracket 46. As will be hereinafter discussed, toggle assembly 47 provides a holding force on operating shaft 44 when in the unactuated position. Further, during operation, once an over-toggle point is reached, the toggle assembly 47 aids the human operator in rotating the operating shaft 44. Toggle assembly 47 includes a pair of spaced flanges 48, a T-shaped pin 50, a trunion 52 and a toggle spring 54. Flanges 48 are secured to operating shaft 44 and rotatable therewith. The spaced flanges 48 extend radially outwardly from operating shaft 44 and are coupled to T-shaped pin 50 which is itself slidably mounted to trunion 52. The trunion 52 is rotatably carried in support bracket 46. Toggle spring 54 is carried between trunion 52 and the outwardly extending arms 56 of T-shaped pin 50. Because T-shaped pin 50 is secured to flanges 48 and is also slidably received in trunion 52, toggle spring 54 will variably compress or expand based on the rotational position of operating shaft 44. In other words, as will be discussed in greater detail below, toggle spring 54 either resists or aids rotation of operating shaft 44 depending upon the direction of rotation and angular position of operating shaft 44.

Flanges 48 are coupled to a transfer shaft 58 at a location angularly offset (with respect to operating shaft 44) from T-shaped pin 54. Transfer shaft 58 is spaced from, and extends parallel to operating shaft 44, through a first arc shaped slot 59 in support bracket 46. As can be seen, rotation of operating shaft 44 draws transfer shaft 58 through an arcing, semi-circular path.

A charging assembly 49 is provided on the opposed side of support bracket 46. As will be hereinafter discussed, charging assembly 49 acts to compress a main spring 76 when operating shaft 44 is rotated. In this manner, main spring 76 stores the energy necessary to manually operate the breaker 10. Charging assembly 49 includes a main spring arm 60 which is rotatably coupled to transfer shaft 58 at the opposed end from flanges 48. Main spring arm 60 includes a generally J-shaped bottom portion 62 that wraps around, but is not coupled to, a pivot shaft 63 that extends from support bracket 46 and is axially aligned with operating shaft 44. Main spring arm 60 extends upwardly from J-shaped portion 62 and terminates at the top at a T-shaped mounting area 64.

Charging assembly 49 further includes a pair of pivot arms 66 and a bracket 68. Each arm of the T-shaped mounting area 64 is coupled to one of the pivot arms 66, which are each rotatably secured to bracket 68. Thus, main spring arm 60 is carried at the top by a pair of pivoting arms 66 and carried on the bottom on transfer shaft 58. As will be discussed in greater detail below, main spring arm 60 moves up or down (relative to pivot shaft 63), in a generally arcing motion, when operating shaft 44 rotates. For example, from a starting point of the configuration of FIGS. 6-9, if operating shaft 44 rotates clockwise (hereinafter rotational direction is taken from the reference point of the handle end of operating shaft 44), transfer shaft 58 will travel downward in an arcing fashion. Because main spring arm 60 is pivotally secured to transfer shaft 58, and because pivot arms 66 allow downward movement, main spring arm 60 will thus move downward, relative to pivot shaft 63.

Main spring arm 60 further includes a generally flat, landing surface 70 and a spring receiving portion 72 that extends between landing surface 70 and the T-shaped mounting area 64. A base plate 74 is received on the spring receiving portion 72 and is slidable on spring receiving portion 72 until reaching landing surface 70, wherein further sliding movement is prevented. A main spring 76 is positioned on spring receiving portion and is secured between T-shaped mounting area 64 and base plate 74. Thus, main spring 76 is compressible between T-shaped mounting area and base plate 74.

The pivot shaft 63 carries a trigger assembly 78 that, as will be discussed below, enables the spring charge on main spring 76 to grow, and ultimately release, allowing main spring 76 to rotate crank shaft 26. Trigger assembly 78 includes a pair of bottom linkages 80 and a pair of top linkages 82. Bottom linkages 80 are positioned on each side of main spring arm 60 and are secured to pivot shaft 63 in a manner allowing rotation thereon. Bottom linkages 80 extend upwardly and are secured to top linkages 82 by a fastener 84 that allows for relative pivoting motion therebetween. The opposed ends of top linkages 82 are coupled together by a guide pin 86 which is received in a guide channel 88 running longitudinally on main spring arm 60. Guide channel 88 extends downwardly from proximate to landing surface 70 into spring receiving portion 72.

A foot extends rearwardly from bottom linkage 80*a* and attaches to a tension spring 92, which is secured to a bracket 94. In this manner, bottom linkages 80 are biased in the counterclockwise direction. The bottom linkage 80*b* closest to support bracket 46 further includes a trigger 96 that extends through a second arced slot 98 in support bracket 46. As will be discussed in greater detail below, trigger 96 is positioned to contact a leading edge of flange 48 when operating shaft 44 is rotated to a predetermined position.

Slot 98 is semi-circular and includes a stop edge 99 trigger 96 is freely movable through slot 98 until engaging stop edge 99, which thereafter prevents relative rotation between top and bottom linkages 82 and 80 beyond a predefined angle. According to one embodiment, the predefined angle is about 185 degrees. In this or other embodiments, range could be from about 182 to about 185 degrees. Thus, without any other forces acting on trigger assembly 78, spring 92 pulls bottom linkages 80 rearward until further relative rotation between bottom and top linkage is prevented by the trigger 96 contacting stop edge 99 and rotation of the trigger assembly 78 as a whole is prevented by guide pin 86 contacting the walls of guide channel 88. In this support configuration, bottom linkages 80 are oriented at approximately 185 degrees relative to top linkages 82. Hereinafter, this configuration is referred to as the first or steady state configuration. It should further be appreciated that trigger assembly, when in this first configuration, is capable of supporting a downward directed force at the top of top linkage 82.

Manual actuator 40 may also include an electrical interlock switch 100 (see FIG. 9) which is positioned to sense when operating shaft 44 rotates. If rotation (indicating manual actuation) is sensed, operation of the magnetic actuator 30 is prevented, even if normal operating power is available.

During normal automatic operation, manual actuator 40 remains in the first, steady state configuration as shown in FIGS. 1-9. When in the steady state configuration, toggle spring 54 imparts a force on flanges 48 urging operating shaft 44 in the counterclockwise direction. However, rotation is prevented because counterclockwise rotation of flanges 48 would cause upward movement of main spring arm 60, which is prevented from doing so because J-shaped portion 62 engages pivot shaft 63. Thus, toggle spring 54 holds operating shaft 44, and consequently handle 42 in a first operating position.

When handle 42 is in the first operating position, trigger assembly 78 is in a holding, weight bearing position, wherein, the top linkages 82 are angled slightly and trigger 96 rests against stop edge 99. When in this configuration, the manual actuator 40 does not affect or inhibit the operation of breaker 10. Specifically, base plate 74 is held above, but do not contact, a pair of lever arms 104 coupled to crank shaft 26.

When in the first, steady state position, base plate 74 is supported by landing surface 70 and the top edge of top linkage 82 is proximate too, but does not contact base plate 74. As will be discussed below in greater detail, such a configuration allows the manual actuator to properly reset (i.e. allows trigger assembly to reposition in the steady state position) after manually actuating breaker 10.

Figure 10:
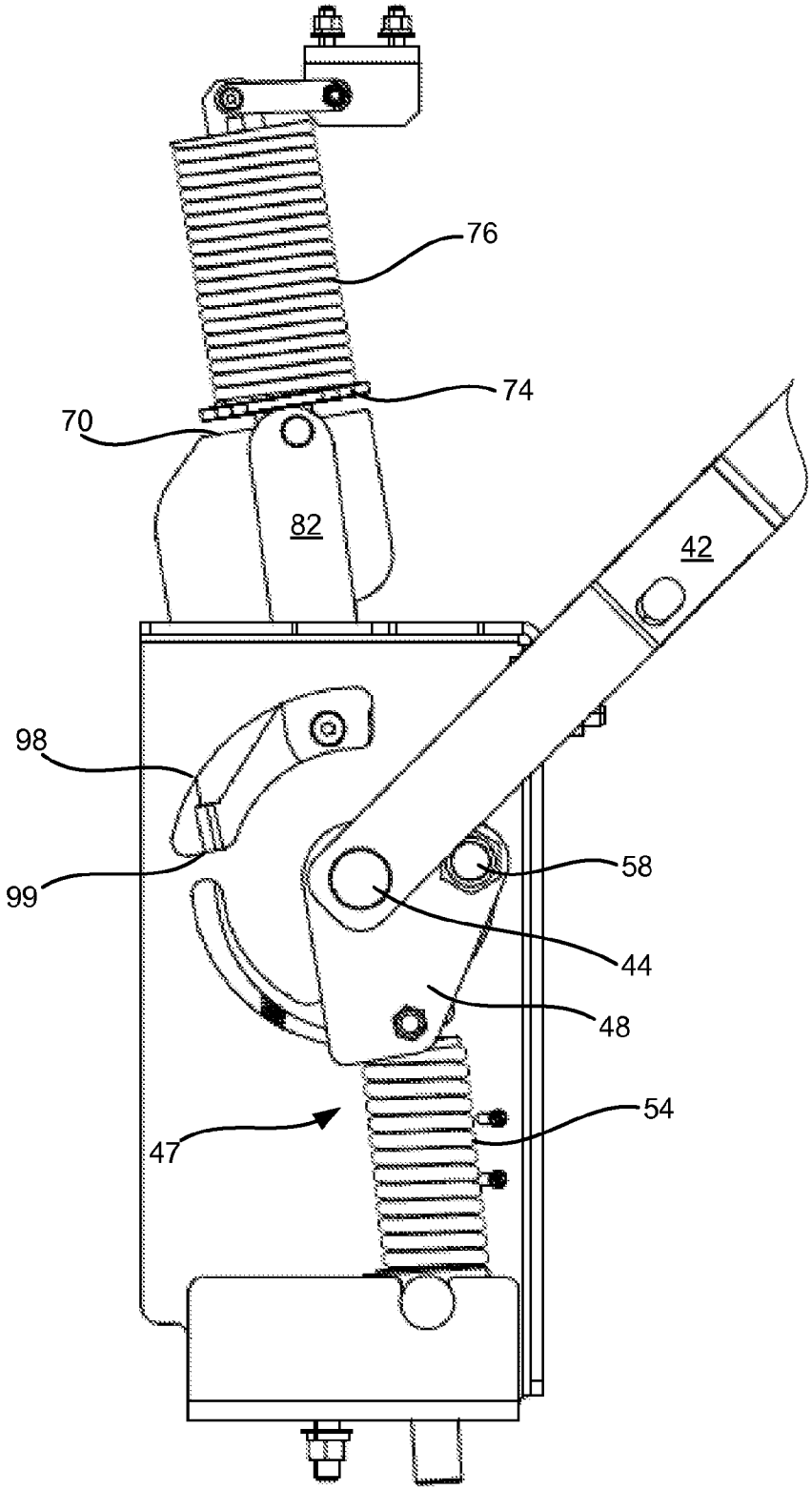
FIG. 10 is a side profile view of the manual actuator in a second position wherein the housing, poles, magnetic actuator, and crank shaft are removed for clarity.
Figure 11:
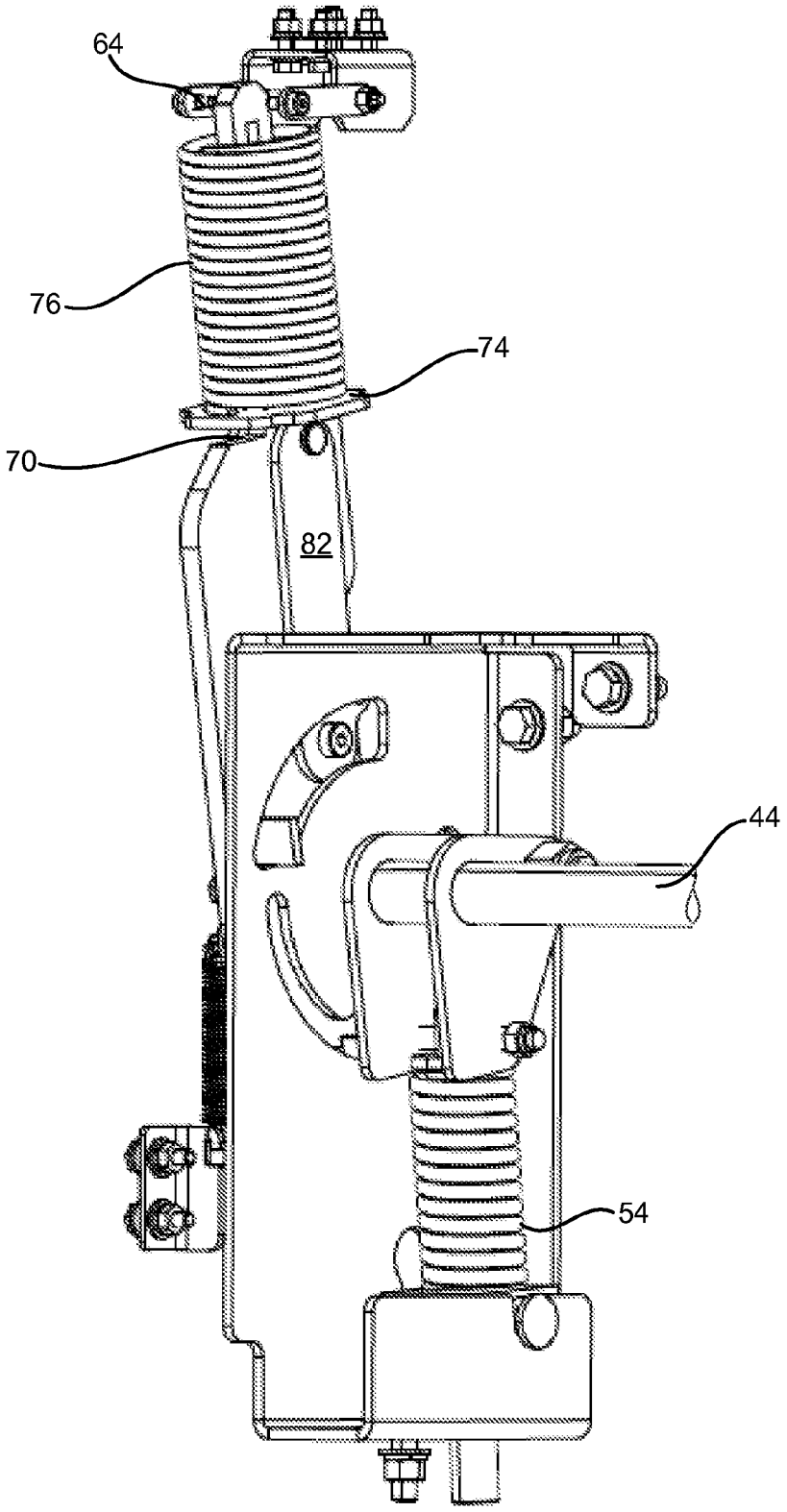
FIG. 11 is a rear and right side view of the manual actuator of FIG. 10.
Figure 12:
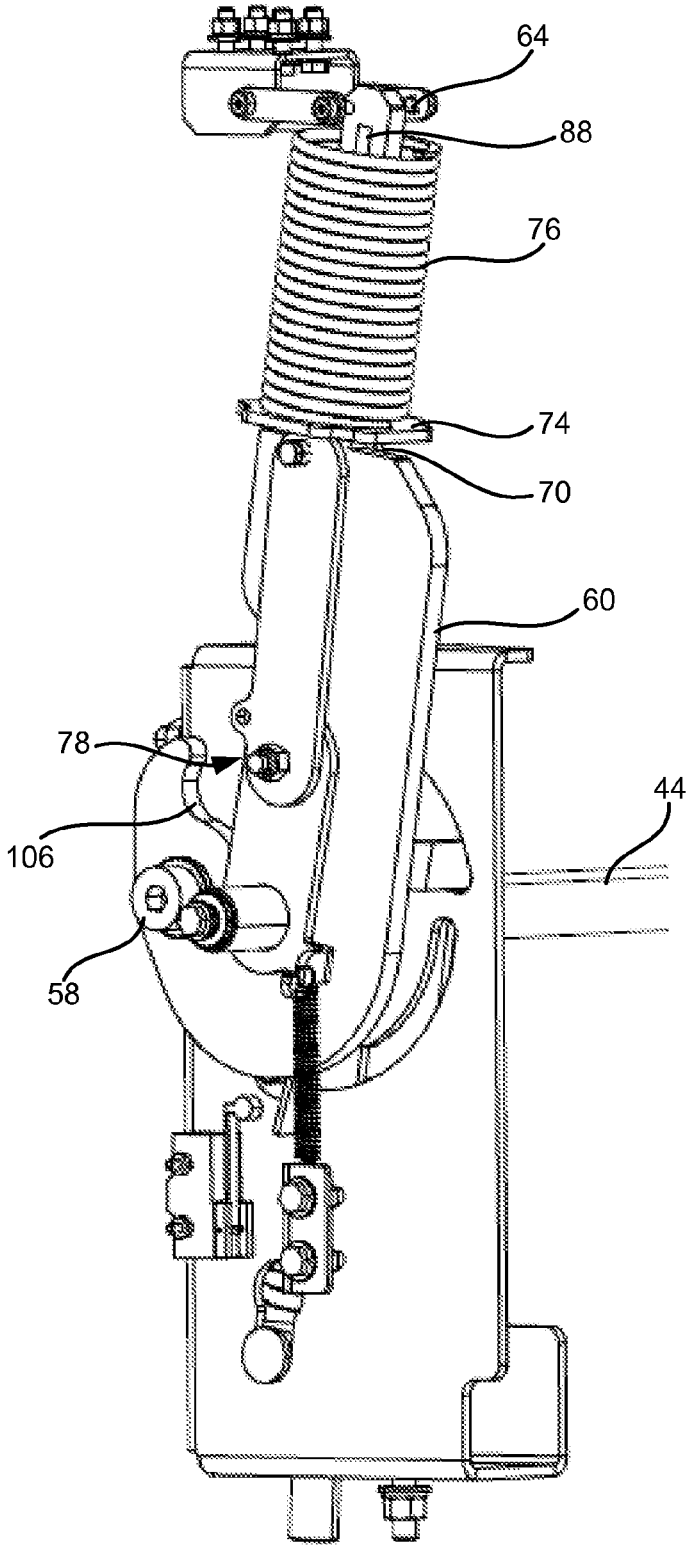
FIG. 12 is a rear and left side view of the manual actuator of FIG. 10.

If manual actuation of breaker 10 is required, a human operator grips exterior handle and causes operating shaft 44 to rotate clockwise. With reference now to FIGS. 10-12, a second operating shaft position is shown representing the initiation of a manual actuation when a human operator pulls on handle 42. As can be seen, as the operating shaft 44 rotates, the rotation is resisted by toggle spring 54, which is in compression and is acting on flanges 48.

Clockwise rotation of operating shaft 44 causes main spring to 76 to begin charging. Specifically, because main spring arm 60 is connected to flanges 48 via transfer shaft 58, rotation of flange 48 causes main spring arm 60 to lower. As main spring arm 60 is lowered, trigger assembly 78 contacts base plate 74 and landing surface 70 is drawn away from base plate 74 which is held in place by top linkage 82. In this manner, trigger assembly 78 takes up the force of the main spring 76 as landing surface 70 moves away. According to one embodiment, main spring 76 may be selected and positioned so that, when in the steady state position, the spring is pre-compressed.

As discussed above, main spring 76 is secured between T-shaped mounting area 64 of main spring arm 60 and base plate 74. Thus, as main spring arm 60 is lowered, main spring 76 is compressed because T-shaped mounting area 64 is dawn lower and base plate 74 is held in place by trigger assembly 78. In this manner, rotation of operating shaft 44 causes main spring 76 to charge.

Figure 13:
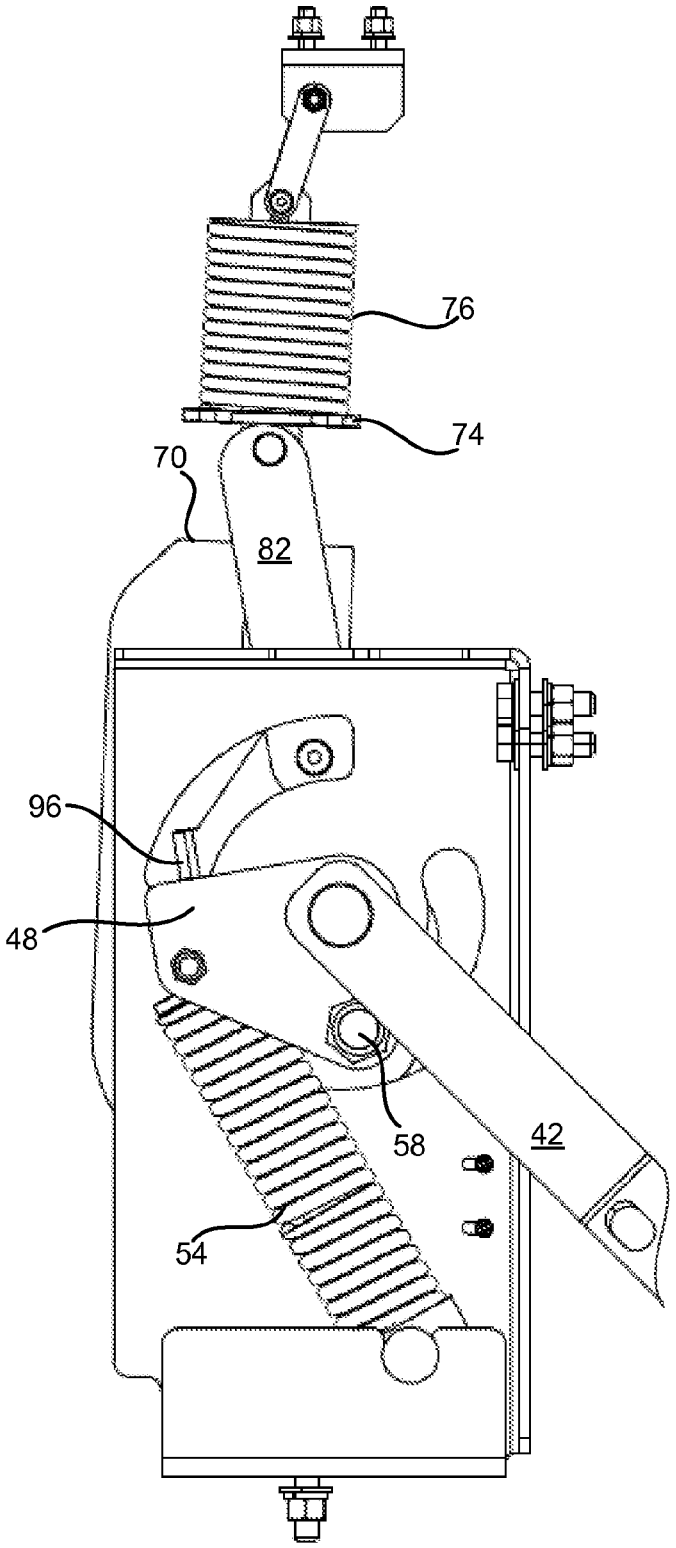
FIG. 13 is a side profile view of the manual actuator in a third position just before triggering, wherein the housing, poles, magnetic actuator, and crank shaft are removed for clarity.
Figure 14:
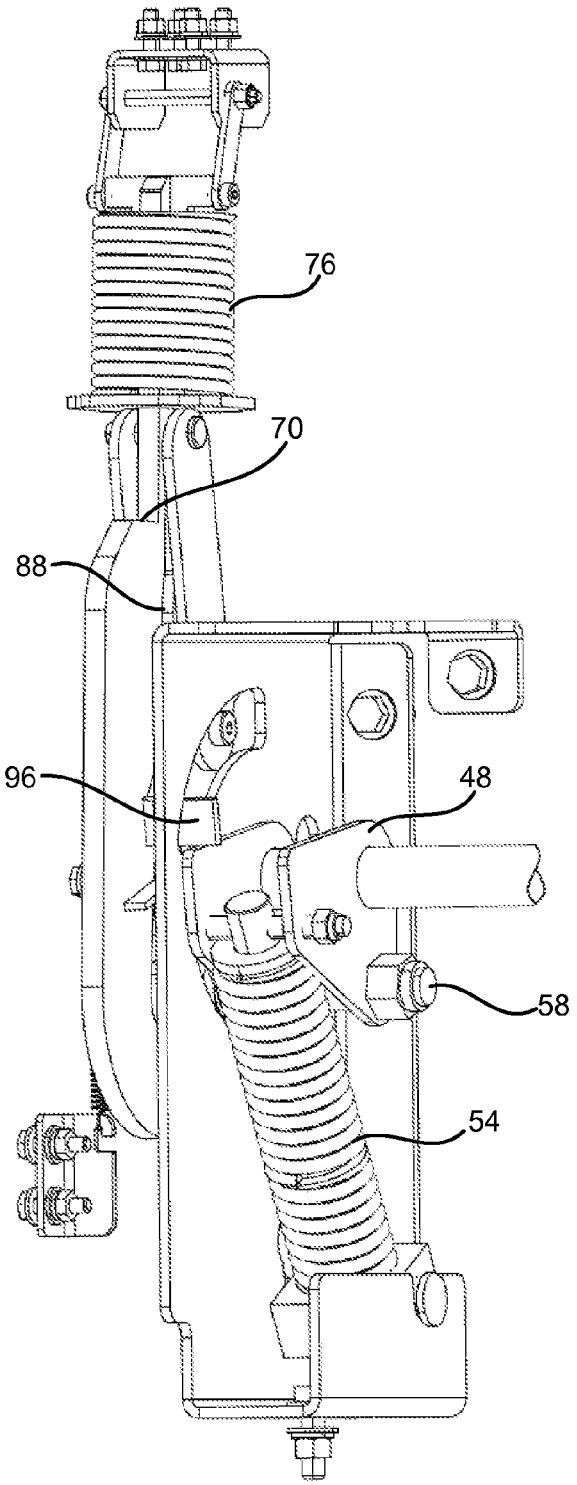
FIG. 14 is a rear and right side view of the manual actuator of FIG. 13.
Figure 15:
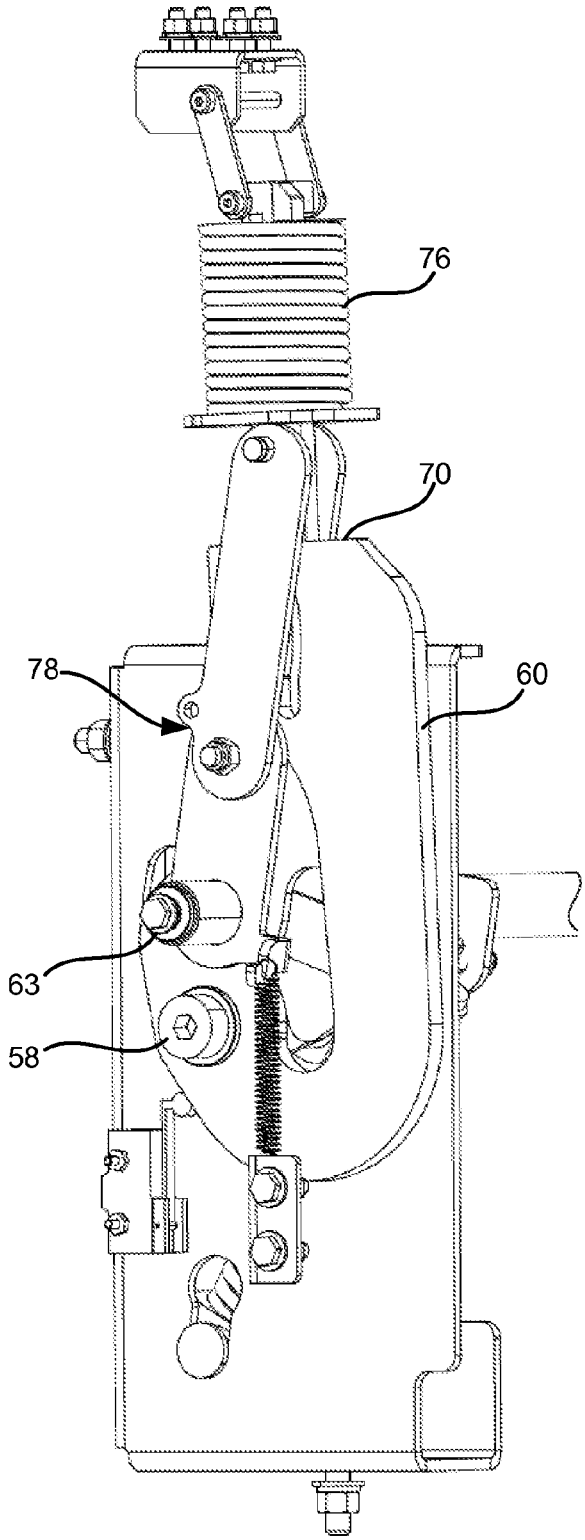
FIG. 15 is a rear and left side view of the manual actuator of FIG. 13.
Figure 16:
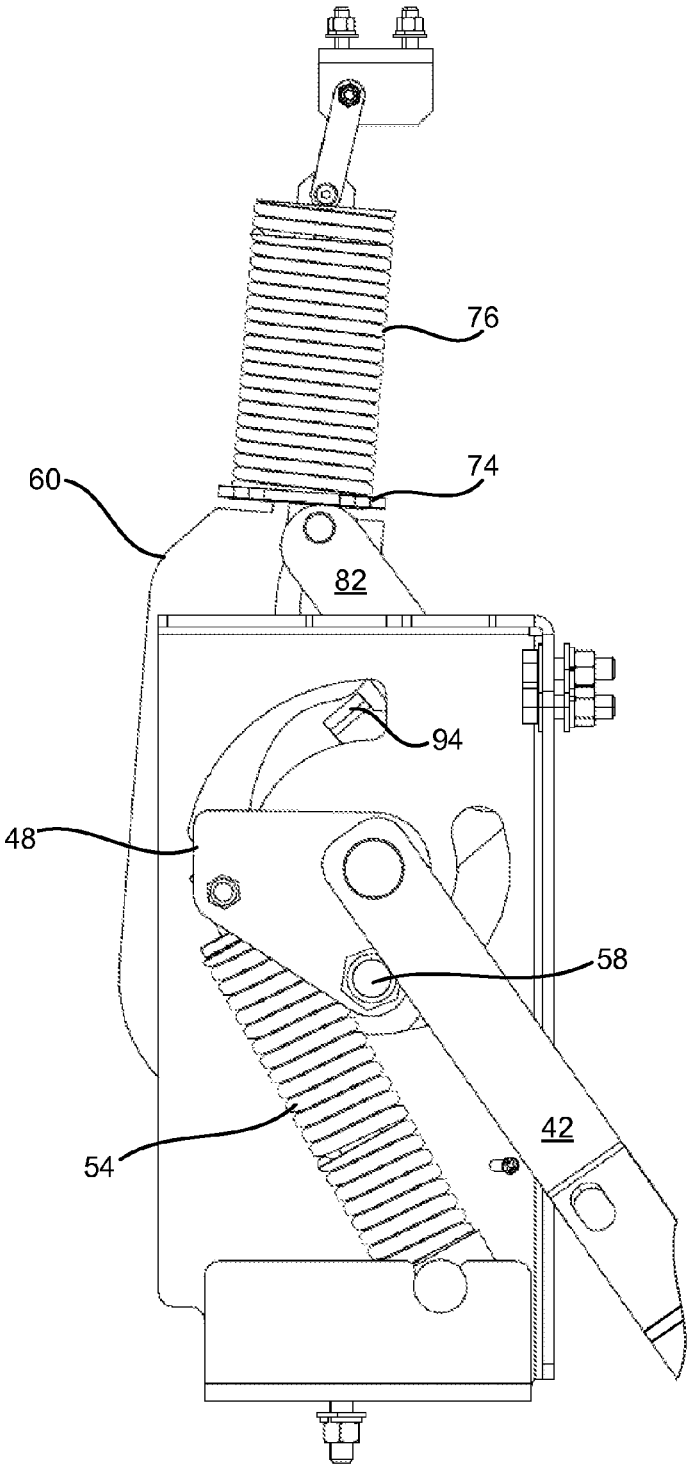
FIG. 16 is a side profile view of the manual actuator in a fourth position after triggering, wherein the housing, poles, magnetic actuator, and crank shaft are removed for clarity.
Figure 17:
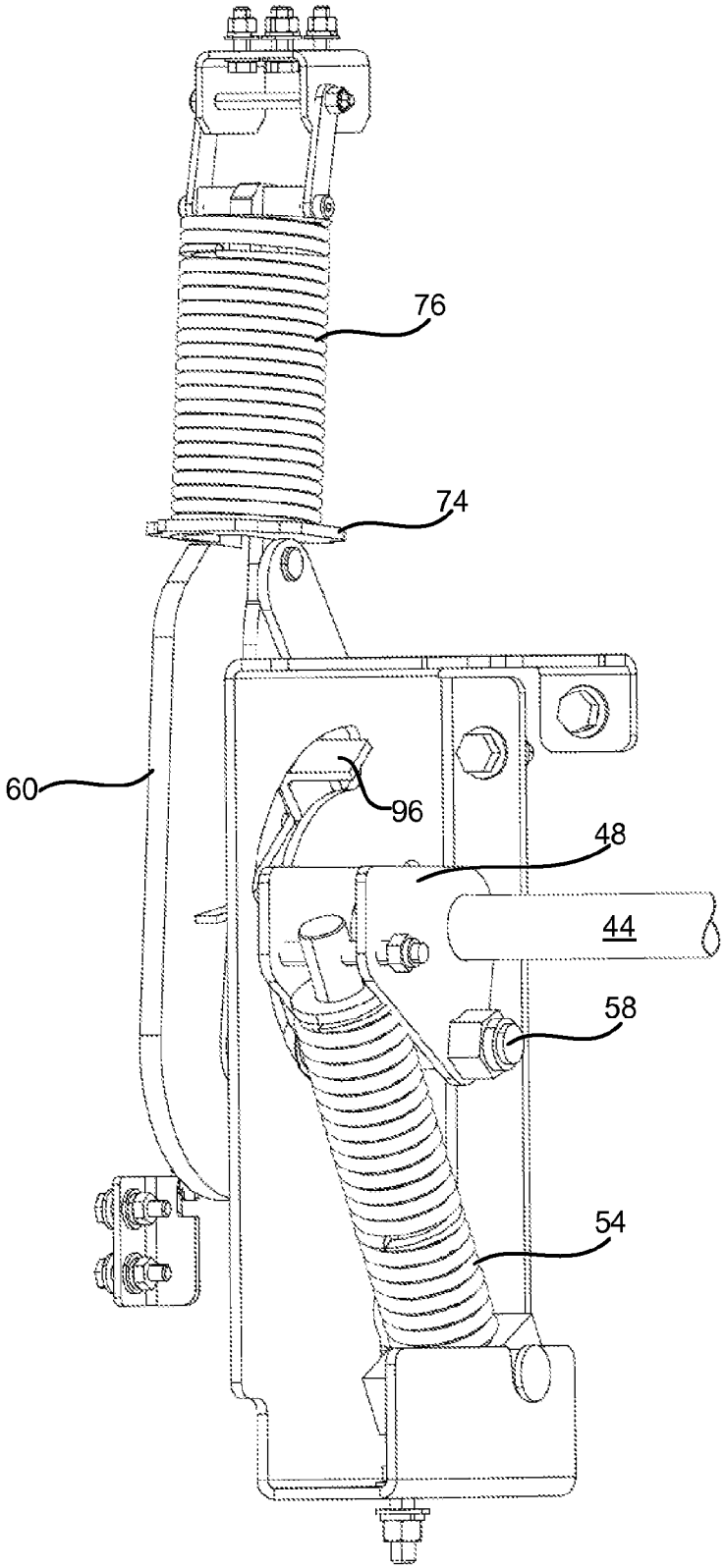
FIG. 17 is a rear and right side view of the manual actuator of FIG. 16.
Figure 18:
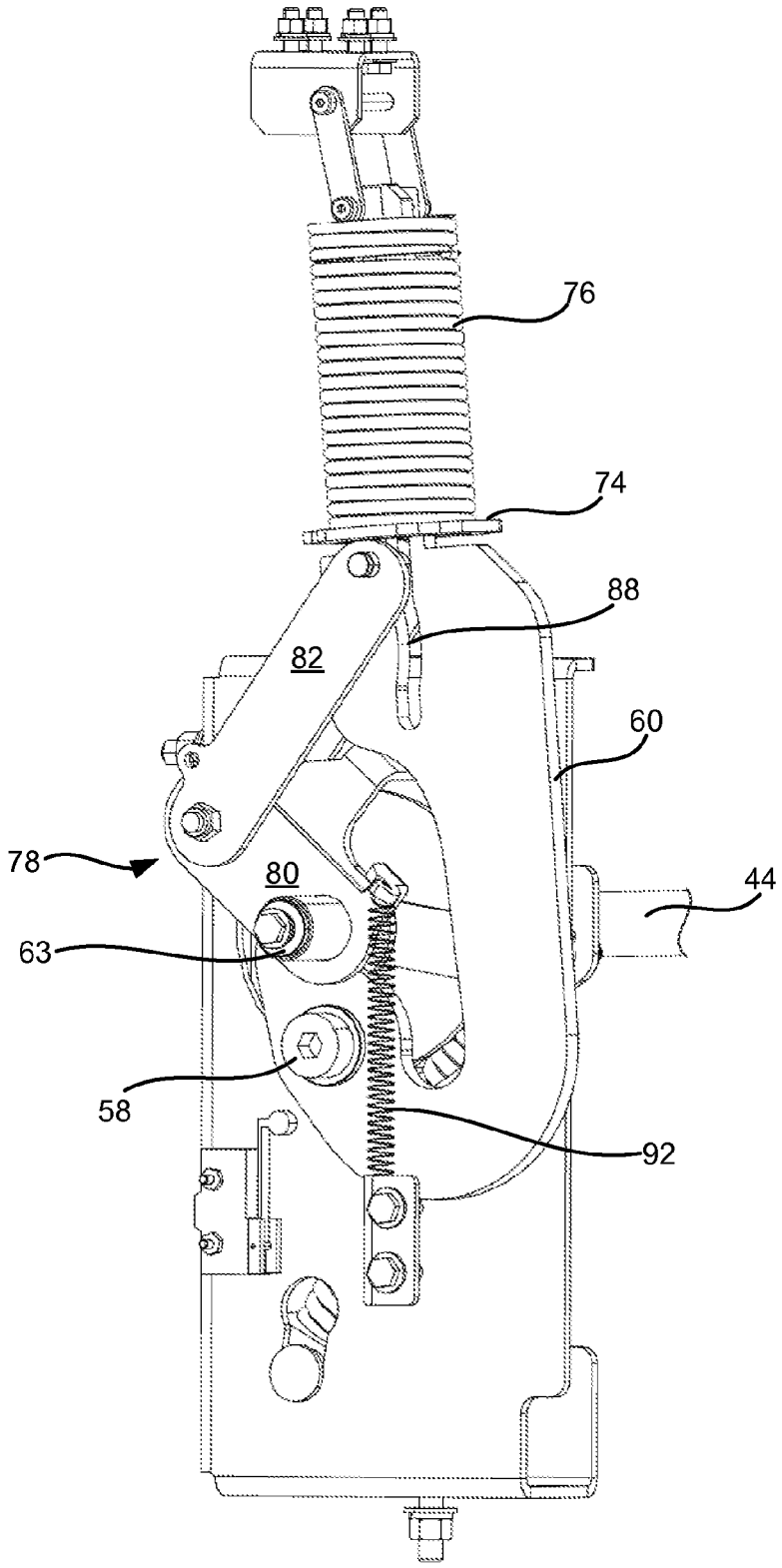
FIG. 18 is a rear and left side view of the manual actuator of FIG. 16.

Further rotation of operating shaft 44 causes toggle spring 54 to compress and trunion 52 to pivot until the trunion 52 reaches a toggle point, wherein the longitudinal axis of toggle spring 54 is radially aligned with operating shaft 44. After reaching the toggle point, further clockwise movement, as shown in FIGS. 13-15 is aided by toggle spring 54. Thus, as compression on main spring 76 increases (thereby increasing the resistance against further clockwise movement), toggle spring 54 begins to aid clockwise motion of operating shaft 44. As operating shaft 44 continues to rotate, trigger assembly 78 continues to support main spring 76 while main spring arm 60 continues to move downward, compressing spring 76.

As the operating shaft 44 continues to rotate, main spring arm 60 continues to move downwardly relative to base plate 74. However, because transfer shaft 58 moves in an arcing motion, as operating shaft 44 rotates, the component of the main spring force resisting rotation grows smaller. In other words, as the charge on the main spring grows, the effective moment arm is reduced. In this manner, the required input torque by the human operator is reduced and held within an acceptable range throughout the rotation of the operating handle 42.

With reference now to FIGS. 13-15, an initial trip configuration or trigger point is shown, wherein the leading edge of flange 48 contacts trigger 96. At this time, main spring 76 is substantially fully charged. According to one embodiment, when in the initial trip position, the transfer shaft 58 is proximate to the lowest point in its arced travel path. In other words, when in the initial trip configuration, the main spring 76 is at or near its maximum compression.

Figure 19:
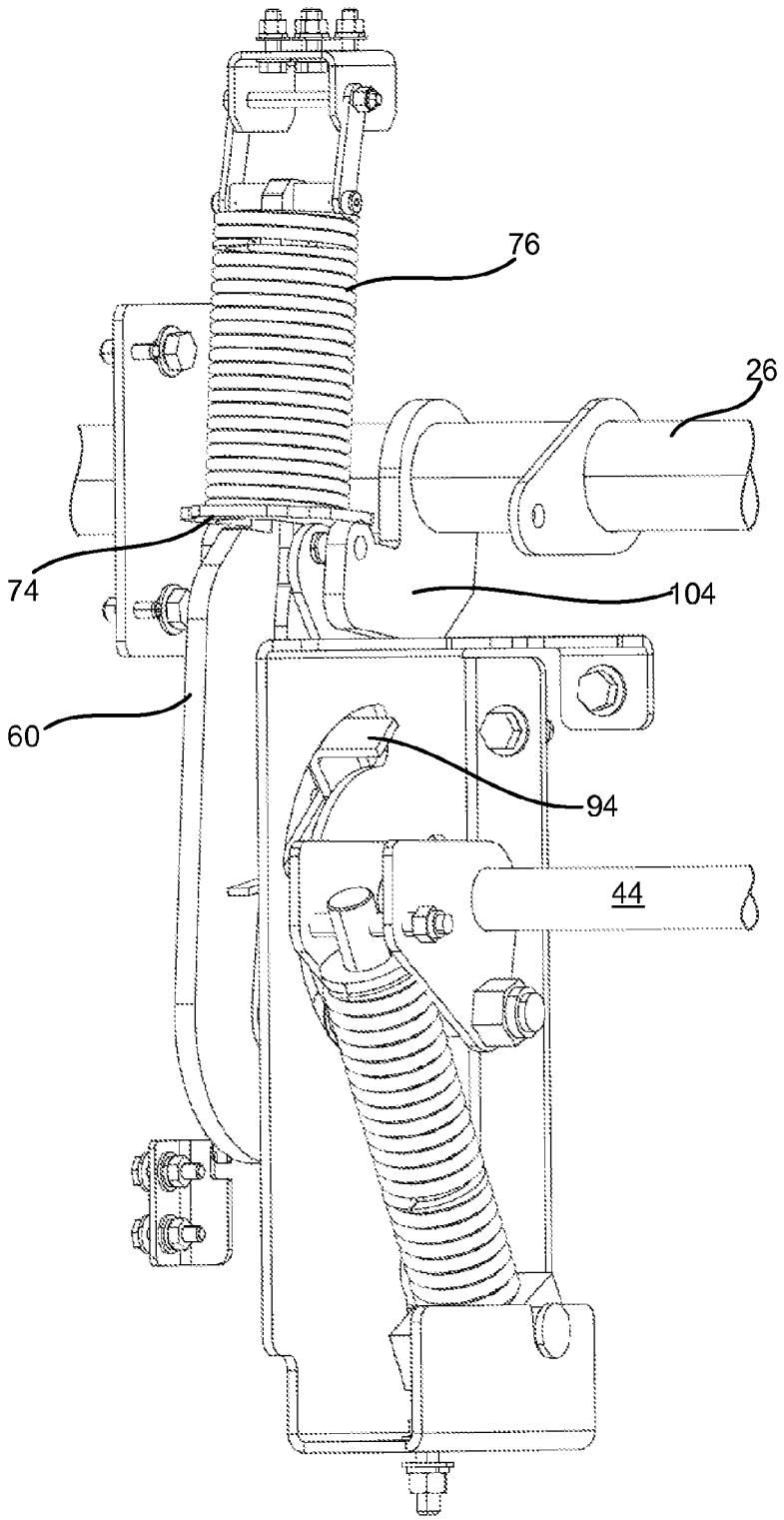
FIG. 19 is a rear and right side view of the manual actuator of FIG. 16 showing the crank shaft.

When flange 48 contacts trigger 96, bottom linkage 80 is forced in a clockwise motion, causing the relative angle between top linkages 82 and bottom linkages 80 to rotate to less than 180 degrees. This causes trigger assembly 78 to destabilize. With the base plate 74 no longer supported by trigger assembly 78, main spring 76 rapidly forces base plate 74 downward and into contact with crank shaft arms 104 which are positioned below base plate 74 (see FIGS. 7, 8, and 19).

With reference now to FIGS. 16-19, it can be seen that main spring 76, acting through base plate 74, contacts crank shaft arms 104, thereby rotating crank shaft 26. The force of main spring 76 is sufficient to overcome the actuator magnet resistance, contact welding, and any other system resistance so that rotation of crank shaft 26 causes the contacts within poles 12 to separate at the appropriate speed. After triggering, it can be seen that the destabilized trigger assembly 78 collapsed and is in a tripped configuration, however, top linkage 82 is still held against base plate 74 by tension spring 92.

Manual actuator 40 may be reset by simply reversing the above disclosed steps. Specifically, counterclockwise rotation of operating shaft 44 causes landing surface 70 to move upwardly, consequently pushing base plate 74 upwardly. Top linkage 80, urged by tension spring 92, follows the movement of base plate 74 until landing surface 70 moves high enough for top linkage 80 to move beyond 180 degrees relative to bottom linkages 80. The steady state position is again reached when trigger 96 contacts stop edge 99. Thereafter, as discussed above, trigger assembly 78 is capable of maintaining the force of main spring 76 during manual actuation until trigger 96 is contacted by flange 48. Further, as discussed above, once in the steady state configuration, toggle spring 54 maintains exterior handle 42 in position. It should be appreciated that, though the manual actuator is reset according to the above described steps, resetting of the manual actuator does not cause rotation of crank shaft 24. Thus, resetting of the manual actuator does not cause the contacts in poles 12 to close.

In this manner, manual actuator 40 provides an internal spring charged, over-toggle mechanism which uses a combination of springs, a trigger mechanism and an external operating handle. According to one embodiment, the manual actuator 40 of the present invention develops approximately 1000 lbs of stored energy in main spring 76 which, when triggered, acts on lever arms 104 attached to the breaker main crankshaft 26. As the manual trip lever is rotated, the mechanism distributes the input force over distance, reducing the maximum force applied by hand at the lever to about 50 lbs.

It should be appreciated that, though the above described circuit breaker is operable via a crank shaft, the manual actuator of the present invention may be incorporated in breakers actuated by other means. For example, the manual actuator may be incorporated in breakers that are actuated via a linear main shaft, which operates the circuit breaker poles by movement along its axis and not by rotation. In such a configuration, the manual actuator may apply the actuating force in the direction of that axis.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

The invention claimed is:

1. A manual operating mechanism for a circuit breaker having a breaker shaft operatively connected to one or more poles, the manual operating mechanism comprising:

an operating shaft having a handle secured thereto;

a charging assembly operatively engaged with said operating shaft through a radially offset linkage, said charging assembly carrying a main spring;

a trigger assembly for engaging and selectively supporting a first end of said main spring; and wherein rotation of said operating shaft in a first direction causes said main spring to compress against said trigger assembly until a trigger point is reached, wherein when said trigger point is reached, said trigger assembly stops supporting said first end of said main spring and said main spring operatively engages said breaker shaft to cause movement thereof.

2. The manual operating mechanism of claim 1, further comprising a toggle assembly operatively connected to said operating shaft, said toggle assembly alternately aiding or resisting rotation of said operating shaft depending on the angular position of said operating shaft.

3. The manual operating mechanism of claim 2 wherein rotation in said first direction is resisted by said toggle assembly until a toggle point is reached, at which time rotation in said first direction is aided, said toggle point being before said trigger point.

4. The manual operating mechanism of claim 2 wherein said toggle assembly comprises a pair of flanges coupled to said operating shaft and a toggle spring carried on a t-shaped pin, said t-shaped pin being secured to said flanges and said radially offset linkage being secured to said flanges.

5. The manual operating mechanism of claim 1 wherein said charging assembly further comprises a main spring arm secured at one end to said radially offset linkage and at the opposed end to a pivoting arm.

6. The manual operating mechanism of claim 1 wherein said main spring arm includes a t-shaped mounting area that engages a second end of said main spring.

7. The manual operating mechanism of claim 1 wherein said trigger assembly includes a support configuration and a tripped configuration, wherein when in said support configuration, said trigger assembly prevents movement of said first end of said main spring, and when said trigger assembly is in said tripped configuration, said trigger assembly does not prevent movement of said first end of said main spring.

8. The manual operating mechanism of claim 7 wherein said trigger assembly includes at least one top linkage and at least one bottom linkage coupled together to allow relative pivoting motion, said bottom linkage including a trigger.

9. The manual operating mechanism of claim 8 further comprising a flange coupled to said operating shaft, wherein when in said support configuration, said trigger engages a stop surface and said top linkage engages a guide channel in said main arm, said trigger point being reached when said flange contacts said trigger to disengage said trigger from said stop surface and destabilize said trigger assembly.

10. A manual operating mechanism for a circuit breaker having a breaker shaft operatively connected to one or more poles, the manual operating mechanism comprising:

an operating shaft having a handle secured thereto;

a charging assembly operatively engaged with said operating shaft, said charging assembly carrying a main spring;

a trigger assembly for engaging and selectively supporting a first end of said main spring, said trigger assembly including a trigger;

a toggle assembly operatively connected to said operating shaft, said toggle assembly alternately aiding or resisting rotation of said operating shaft depending on the angular position of said operating shaft; and wherein rotation of said operating shaft in a first direction causes said main spring to compress against said trigger assembly until said toggle assembly contacts said trigger, at which time, said trigger assembly stops supporting said first end of said main spring and said main spring operatively engages said breaker shaft to cause movement thereof.

11. The manual operating mechanism of claim 10 wherein rotation in said first direction is resisted by said toggle assembly until a toggle point is reached, at which time rotation in said first direction is aided, said toggle point being before said toggle assembly contacts said trigger.

12. The manual operating mechanism of claim 10 wherein said toggle assembly comprises a pair of flanges coupled to said operating shaft and a toggle spring carried on a t-shaped pin, said t-shaped pin being pivotally secured to said flanges.

13. The manual operating mechanism of claim 12 wherein said charging assembly further comprises a main spring arm operatively interconnected at one end to at least one of said flanges and at the opposed end to a pivoting arm.

14. The manual operating mechanism of claim 10 wherein said main spring arm includes a t-shaped mounting area that engages a second end of said main spring.

15. The manual operating mechanism of claim 10 wherein said trigger assembly includes a support configuration and a tripped configuration, wherein when in said support configuration, said trigger assembly prevents movement of said first end of said main spring, and when said trigger assembly is in said tripped configuration, said trigger assembly does not prevent movement of said first end of said main spring.

16. The manual operating mechanism of claim 15 wherein said trigger assembly includes at least one top linkage and at least one bottom linkage coupled together to allow relative pivoting motion, said trigger extending from said bottom linkage.

17. The manual operating mechanism of claim 16 wherein when in said support configuration, said trigger engages a stop surface and said top linkage engages a guide channel in said main arm, said tripped configuration occurring after said flange contacts said trigger causing said trigger to disengage from said stop surface and destabilize said trigger assembly.

* * * * *